United States Patent [19]

Nakamura

[11] 4,289,063

[45] Sep. 15, 1981

[54] HYDRAULIC DRIVING DEVICE

[75] Inventor: Ichiro Nakamura, Ibaraki, Japan

[73] Assignee: Hitachi, Ltd., Tokyo, Japan

[21] Appl. No.: 922,359

[22] Filed: Jul. 6, 1978

[30] Foreign Application Priority Data

Jul. 20, 1977 [JP] Japan ..... 52-86011

[51] Int. Cl.[3] ..... F01L 25/02; F15B 13/042

[52] U.S. Cl. ..... 91/306; 91/403; 91/453; 91/461

[58] Field of Search ..... 91/313, 403, 306, 305, 91/461, 304, 453, 367, 417 R, 235, 321; 137/625.66

[56] References Cited

U.S. PATENT DOCUMENTS

| | | | |
|---|---|---|---|
| 1,965,914 | 7/1934 | Tolkien | 91/305 X |
| 2,157,240 | 5/1939 | Keel | 91/461 X |
| 2,587,571 | 2/1952 | Lombard | 91/461 X |
| 3,090,364 | 5/1963 | Lefevre | 91/305 X |
| 3,162,093 | 12/1964 | Zoller | 91/306 |
| 3,543,642 | 12/1970 | Seamone | 91/461 X |
| 3,804,122 | 4/1974 | Ruhl et al. | 137/625.66 |
| 3,969,985 | 7/1976 | Grieger et al. | 91/417 R |
| 4,139,015 | 2/1979 | Sakai | 91/461 X |

FOREIGN PATENT DOCUMENTS 136252 of 1977 Japan .

*Primary Examiner*—Irwin C. Cohen
*Attorney, Agent, or Firm*—Craig and Antonelli

[57] ABSTRACT

A hydraulic driving device of a circuit breaker which opens and closes a system in response to two signals is principally constructed of a cylinder, a piston, and a main control valve for controlling the motion of the piston. A spool adapted to slide within the main control valve has its motion controlled by four pressure faces. The first pressure face is normally subjected to a high oil pressure. The second pressure face receives a low oil pressure upon application of the first signal, and a high oil pressure upon release thereof. The third pressure face receives a high oil pressure upon application of the second signal, and a low oil pressure upon release thereof. A high or low oil pressure acts on the fourth pressure face in correspondence with the piston motion. The magnitudes of the forces on the respective pressure faces of the spool are set in a predetermined relationship.

7 Claims, 4 Drawing Figures

( $F_{204} < F_{212} < F_{204} + F_{214} < F_{210}$ )

( $F_{204} < F_{212} < F_{204} + F_{214} < F_{210}$ )

HYDRAULIC DRIVING DEVICE

BACKGROUND OF THE INVENTION

This invention relates to a hydraulic driving device which generates a great driving force at high speed. More particularly, it relates to a hydraulic driving device which is used for the opening and closure of a circuit breaker.

The movable contact of a circuit breaker is engaged with and separated from the stationary contact thereof by a piston which slides within a fixed cylinder. The piston is driven by a hydraulic driving device. In the hydraulic driving device, an oil pressure in an oil chamber of the device changes in response to a command which is externally given to either of two pilot valves in order to turn "on" or "off" the circuit breaker. In correspondence with the oil pressure change, a spool is moved to drive the piston. Such a hydraulic driving device, especially a hydraulic driving device for a high-voltage power breaker, requires to effect the following operations in case of any accident of a transmission system:

(1) Even in case where the command for opening the circuit or the command for closing the circuit is released in a short time in the course of the operation of the hydraulic driving device responsive to the command, the particular operation needs to be continued to complete the opening or closure of the circuit.

(2) In case where the command for opening the circuit and the command for closing the circuit are simultaneously given, or where while the operation of the hydraulic driving device responsive to one of the commands is being conducted the other command is given, the command for opening the circuit must take preference in order to secure the safety of the circuit. This function is called "trip free."

(3) In case where the command for closing the circuit is given in the course of the operation responsive to the command for opening the circuit and where the command for closing the circuit is kept given even after the release of the command for opening the circuit, it is necessary to neglect the particular command for closing the circuit and to hold the circuit in the open state until the next command for closing the circuit is given. This function is termed "anti-pumping."

Japanese Unexamined Published Utility Model Registration Application No. 52-136252 discloses a structure which serves to hold a spool within a main control valve in a position for opening a circuit. The provision of a mechanical device within the main control valve as in the proposal, however, renders the structure of the main control valve complicated and cannot meet the aforecited requirements (1)-(3). In order to operate a hydraulic driving device at high speed in response to the change of commands with a simple structure, it is desirable to utilize the pressure itself of oil flowing in the system of the hydraulic driving device.

SUMMARY OF THE INVENTION

An object of this invention is to provide a hydraulic driving device which can ensure the safety of a system when any fault has occurred in the system.

Another object of this invention is to provide a hydraulic driving device which can accomplish the previously-mentioned requirements (1)-(3) by exploiting oil pressures.

According to this invention, four pressure faces are formed in a main control valve. A spool in the main control valve of the hydraulic driving device is controlled by forces which act on the four pressure faces. The first pressure face is normally subjected to a high oil pressure. The second pressure face receives a low oil pressure when a command for opening a circuit is given, and a high oil pressure when the command is released. The third pressure face receives a high oil pressure when a command for closing the circuit is given, and a low oil pressure when the command is released. A high or low oil pressure acts on the fourth pressure face in correspondence with the motion of a piston. The magnitudes of the forces on the respective pressure faces of the spool are set in a predetermined relationship. The hydraulic driving device is provided with an anti-pumping valve which transfers the high oil pressure having acted on the third pressure face, to the low oil pressure after a short time, and a holding valve which bestows the predetermined pressure on the fourth pressure face while the piston is sliding within a cylinder.

DETAILED DESCRIPTION OF THE INVENTION

Figure 1:
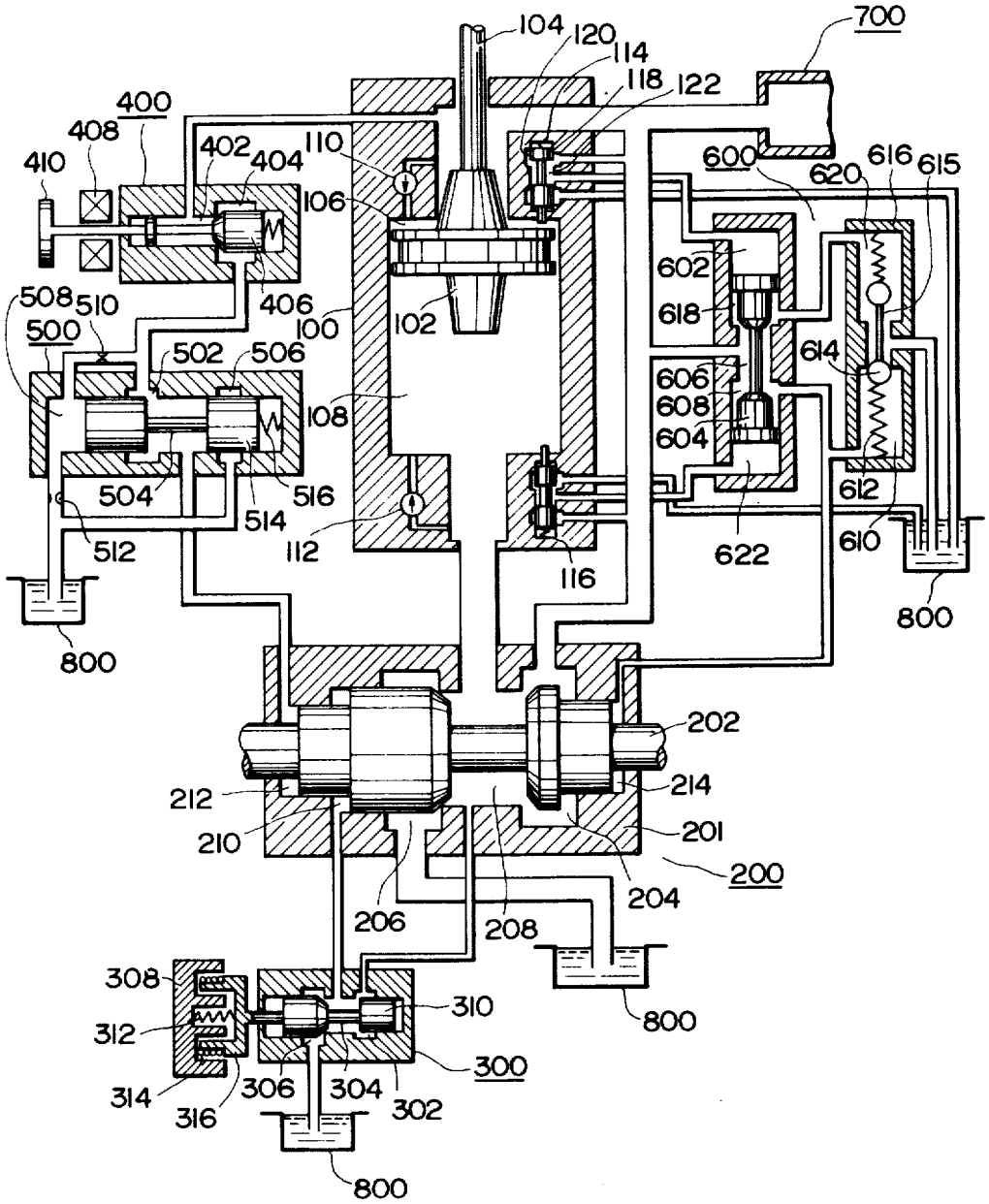
FIG. 1 shows a sectional view of a hydraulic driving device according to this invention.

As shown in FIG. 1, a hydraulic driving device for a circuit breaker (not shown) is principally constructed of a cylinder 100, a piston 102 which slides within the cylinder 100 and drives the circuit breaker, a main control valve 200 which controls the motion of the piston 102 by an oil pressure in the cylinder 100, a first pilot valve 300 which controls the main control valve 200 in compliance with a command for opening the circuit (hereinbelow, the command shall be called the "first signal"), a second pilot valve 400 which controls the main control valve 200 in compliance with a command for closing the circuit (hereinafter, the command shall be termed the "second signal"), an anti-pumping valve 500 which controls the main control valve 200 in cooperation with the second pilot valve 400, a holding valve 600 which controls the main control valve 200 in dependence on the position of the piston 102, an accumulator 700 which supplies high pressure oil to these elements, and oil passages which communicate these elements. Hereunder, the structure of the hydraulic driving device will be described more in detail.

The piston 102 is slidably arranged within the cylinder 100. This piston is mechanically connected to a movable contact of the circuit breaker through a rod 104. In the cylinder 100, chambers 106 and 108 are formed on both sides of the piston 102. The chamber 108 is alternately communicated with the accumulator 700 being a high oil pressure source and a tank 800 being a low oil pressure source by the motion of a spool 202 of the main control valve 200 as will be detailed later. On the other hand, the chamber 106 is normally connected to the accumulator 700. When the high pressure oil flows into the chamber 108, it pushes the piston 102 onto the side of the rod 104 by an oil pressure corresponding to the sectional area of the rod 104, whereas when it flows out to the tank 800, it pulls the piston 102 in the opposite direction. The cylinder 100 is of the both-side cushion type wherein the piston 102 can be smoothly decelerated on both the rod 104 side and the opposite side. In order to eliminate an operating delay at the starting of the piston 102 and to attain a sufficient cushioning, check valves 110 and 112 are disposed.

The main control valve 200 consists of a valve body 201, and the spool 202 which slides within the valve body 201. Between the valve body 201 and the spool 202 there are formed a first valve chest 204 and a second valve chest 206, between which an oil chamber 208 is defined. These chambers 204, 206, and 208 are respectively connected to the accumulator 700, the tank 800, and the chamber 108 in the cylinder 100, and the spool 202 controls the flow of oil. The main control valve 200 further includes a first pilot chamber 210, a second pilot chamber 212 and an oil chamber 214. Oil pressure changes in these chambers 210, 212 and 214 and the first valve chamber 204 are used to control the spool 202.

The spool 202 has faces which receive rightward forces as viewed in the figure, owing to oil pressures acting on the first pilot chamber 210 and the second pilot chamber 212, and faces which receive leftward forces as viewed in the figure, owing to oil pressures acting on the first valve chamber 204 and the oil chamber 214.

The first pilot chamber 210 communicates with the first pilot valve 300, and the oil pressure acting on the first pilot chamber 210 is controlled by the first pilot valve 300.

The second pilot chamber 212 communicates with the second pilot valve 400 through the anti-pumping valve 500. The oil pressure acting on the second pilot chamber 212 is controlled by the cooperation of the second pilot valve 400 and the anti-pumping valve 500.

The first valve chamber 204 is connected to the accumulator 700 at all times, and normally exerts the leftward force on the spool 202.

The oil chamber 214 communicates with the holding valve 600, so that the oil pressure in the oil chamber 214 is controlled by the holding valve 600.

The pressure receiving areas of the spool 202 in the respective chambers 204, 210, 212 and 214 are set so that, letting $F_{210}$, $F_{212}$, $F_{204}$ and $F_{214}$ denote the forces exerted on the spool 202 by the oil pressures in the first pilot chamber 210, the second pilot chamber 212, the first valve chest 204 and the oil chamber 214, respectively, the following relationship may hold among these forces:

$$F_{204} < F_{212} < F_{204} + F_{214} < F_{210}$$

Now, the structure and operation of the first pilot valve 300 will be described. The first pilot valve 300 is a three-way valve which is disposed at an intermediate position of the passage connecting the oil chamber 208 and first pilot chamber 210 of the main control valve 200 and which is driven by the first signal. The first pilot valve 300 has an oil chamber 302 which is connected with the oil chamber 208 of the main control valve 200, an oil chamber 304 which is connected with the first pilot chamber 210 of the main control valve 200, and an oil chamber 306 which is connected with the tank 800. A spool 310 which is driven by a force motor 308 controls oil flowing among these oil chambers 302, 304 and 306. The spool 310 is usually urged rightwards as viewed in the figure by a spring 312 so as to communicate the oil chamber 302 and the oil chamber 304. When the first signal is impressed on a coil 314 of the force motor 308, the coil 314 moves leftwards as viewed in the figure, and also the spool 310 which is integral with the coil 314 through a coil bobbin 316 moves leftwards. As a result, the spool 310 cuts off the communication between the oil chamber 302 and the oil chamber 304 and brings the oil chamber 304 and the oil chamber 306 into communication.

Now, the structure and operation of the second pilot valve 400 as well as the anti-pumping valve 500 will be described. The second pilot valve 400 is an on-off valve, and is disposed between the accumulator 700 and the anti-pumping valve 500. An oil chamber 402 of the second pilot valve 400 is connected to the accumulator 700, and an oil chamber 404 thereof is connected to the anti-pumping valve 500. Ordinarily, a spool 406 cuts off the communication between the oil chambers 402 and 404. When a magnet coil 408 receives the second signal, it attracts a plate 410 to move the spool 406 rightwards and to communicate the oil chambers 402 and 404.

The anti-pumping valve 500 has oil chambers 502, 504, and 506, which are respectively connected to the oil chamber 404 of the second pilot valve 400, the second pilot chamber 212 of the main control valve 200, and the tank 800. An oil chamber 508 is connected with the oil chamber 404 of the second pilot valve 400 via a constriction 510, and is also connected with the tank 800 via a constriction 512. A spool 514 is normally urged leftwards by a spring 516 so as to communicate the oil chambers 502 and 504. When the second pilot valve 400 receives the second signal, it falls into the open state as described before. The high pressure oil flows into the second pilot chamber 212 of the main control valve 200 via the oil chambers 502 and 504 of the anti-pumping valve 500. The spool 202 of the main control valve 200 moves rightwards. Part of the high pressure oil from the second pilot valve 400 flows into the oil chamber 508 of the anti-pumping valve 500 via the constriction 510. The high pressure oil having flowed into the oil chamber 508 is discharged to the tank 800 via the constriction 512. At this time, owing to the two constrictions 510 and 512, the interior of the oil chamber 508 falls into a pressure intermediate between the high pressure of the accumulator 700 and the low pressure of the tank 800, and a force pushing the spool 514 rightwards develops. Meanwhile, the spool 514 is moved rightwards by the oil pressure in the oil chamber 508, and the anti-pumping valve 500 is switched at a comparatively low speed. As a result, the high pressure oil having flowed into the oil chamber 212 of the main control valve 200 is discharged to the tank 800 via the oil chambers 504 and 506 of the anti-pumping valve 500. In this manner, the anti-pumping valve 500 functions to discharge the oil having flowed into the second pilot chamber 212 of the main control valve 200 in response to the second signal, to the tank 800 after a fixed time.

Description will now be made of the structures and operations of position detecting valves 114 and 116 which detect the positions of the piston 102, and the holding valve 600 which operates in compliance with the commands of the position detecting valves 114 and 116. The position detecting valves 114 and 116 and the holding valve 600 operate in cooperation. When the piston 102 has come near a stroke end on the rod 104 side, it pushes up a spool 118 of the position detecting valve 114. The high pressure oil from the accumulator 700 flows into an oil chamber 602 of the holding valve 600 via oil chambers 120 and 122 of the position detecting valve 114, and switches a spool 604 downwards as shown in the figure. The high pressure oil of an oil chamber 606 normally connected with the accumulator 700 flows into oil chambers 608 and 610, to hold the spool 604 at that position and simultaneously to switch a valve 616 including springs 612, balls 614 and a rod 615 for coupling the balls 614. The high pressure oil in oil chambers 618 and 620 flows out to the tank 800. Thenceforth, even when the piston 102 comes away from the position detecting valve 114, the position detecting valve 114 returns to the original position, the high pressure oil of the oil chamber 602 is discharged to the tank 800 via the position detecting valve 114 and the force pushing the spool 604 is removed, the spool 604 holds its position owing to the oil pressure of the oil chamber 608 and this state is not switched until the oil pressure in the oil chamber 622 becomes higher than that in the oil chamber 608. Thus, the high pressure oil flows into the oil chamber 214 of the main control valve 200 as communicates with the oil chamber 608.

When the piston 102 has come near a stroke end on the side opposite to the rod 104, it switches the position detecting valve 116 and supplies the high pressure oil in the accumulator 700 to an oil chamber 622 of the holding valve 600. Thus, likewise to the case of the position detecting valve 114, the spool 604 moves upwards as viewed in the figure against the oil pressure of the oil chamber 608, and the high pressure oil flows into the oil chambers 618 and 620 to hold the spool 604 at that position and to switch the valve 616. Thus, the high pressure oil in the oil chamber 214 of the main control valve 200 is discharged to the tank 800 via the oil chamber 610.

The position detecting valve 114 and 116 and the holding valve 600 operate in this manner, so that when the piston 102 lies at the stroke end on the rod 104 side and while it is moving towards the side opposite to the rod 104, the oil chambers 608 and 610 are under the high pressure, the high pressure oil flowing into the oil chamber 214 of the main control valve 200. On the other hand, when the piston 102 lies at the stroke end on the side opposite to the rod 104 and while it is moving towards the rod 104 side, the oil chambers 618 and 620 are under the high pressure, the oil pressures 608 and 610 are under the low pressure and the oil chamber 214 of the main control valve 200 is under the low pressure.

Illustrated in FIG. 1 is the state of the hydraulic driving device as corresponds to the closure of the circuit breaker. The first pilot chamber 210, the first valve chamber 204 and the oil chamber 214 are under the high pressure, while the second pilot chamber 212 and the second valve chest 206 are under the low pressure. From the foregoing equation, accordingly, the forces acting on the spool 202 are related as follows:

$$F_{210} > F_{204} + F_{214}$$

Therefore, the spool 202 holds the state in which it is subjected to the rightward force.

The operation of the hydraulic driving device in the case of applying the first signal to the first pilot valve 300 under this state will now be described with reference to FIGS. 1 and 2. When the force motor 308 of the first pilot valve 300 receives the first signal at a certain time $t_0$, it draws the spool 310 leftwards at high speed, cuts off the communication between the oil chambers 302 and 304 and brings the oil chambers 304 and 306 into communication. The high pressure oil of the pilot chamber 210 of the main control valve 200 flows out to the tank 800, and the force $F_{210}$ pushing the spool 202 rightwards lowers. In consequence, owing to the force $F_{204}+F_{214}$, the spool 202 moves leftwards at high speed to cut off the communication between the first valve chamber 204 and the oil chamber 208 and to bring the second valve chamber 206 and the oil chamber 208 into communication. The high pressure oil in the chamber 108 of the cylinder 100 flows out to the tank 800, and the force pushing the piston 102 towards the rod 104 side lowers. As a result, the piston 102 moves towards the side opposite to the rod 104, and the movable contact of the circuit breaker as mechanically connected with the rod 104 is separated from the stationary contact at high speed. In the course of the above operation, the position detecting valve 114 is reset by the spring force, but the oil chamber 214 of the main control valve 200 maintains the high pressure by the function of the holding valve 600 as previously stated.

When the piston 102 has reached the vicinity of the stroke end on the side opposite to the rod 104 at a time $t_1$, it switches the position detecting valve 116. The high pressure oil flows into the oil chamber 622 of the holding valve 600, and switches the holding valve 600. The high pressure oil in the oil chamber 214 of the main control valve 200 flows out to the tank 800, and the force $F_{214}$ pushing the spool 202 leftwards lowers. Thereafter, at a time $t_2$ after lapse of a predetermined period of time, the first signal is released. Even when, upon the release of the first signal, the spool 310 of the first pilot valve 300 is returned by the original position by the force of the spring 312, the pressure of the first pilot chamber 210 is low and the force pushing the spool 202 rightwards is not generated because the oil chamber 208 is under the low pressure.

Under the state under which the operation corresponding to the first signal has been completed in this way, the spool 202 of the main control valve 200 is pushed leftwards by only the force $F_{204}$ exerted from the oil chamber 204, and the piston 102 is located at the stroke end on the side opposite to the rod 104.

In the next place, description will be made of the operation of the hydraulic driving device in the case of applying the second signal to the second pilot valve 400. When the electromagnet 408 of the second pilot valve 400 receives the second signal at a time $t_3$, the spool 406 is pushed rightwards, and the high pressure oil flows into the oil chamber 502 of the anti-pumping valve 500. The high pressure oil having flowed into the oil chamber 502 of the anti-pumping valve 500 flows into the oil chamber 212 of the main control valve 200 via the oil chamber 504, and pushes the spool 202 rightwards by the force $F_{212}$. Accordingly, the spool 202 is moved rightwards by a force $F_{212}-F_{204}$, to cut off the communication between the second valve chest 206 and the oil chamber 208 and to bring the first valve chest 204 and the oil chamber 208 into communication. The high pressure oil in the first valve chest 204 flows into the chamber 108 of the cylinder 100, and pushes the piston 102 onto the rod 104 side. As a result, the piston 102 closes the circuit breaker through the rod 104. On the other hand, the high pressure oil in the oil chamber 208 flows into the first pilot chamber 210, and the first pilot chamber 210 becomes the high pressure at a time $t_4$. The high pressure oil supplied to the anti-pumping valve 500 via the second pilot valve 400 drives the spool 202 of the main control valve 200 as described before, and part of the high pressure oil flows into the oil chamber 508 via the constriction 510. The high pressure oil having flowed into the oil chamber 508 is discharged to the tank 800 via the constriction 512. By adjusting the resistances of the two constrictions 510 and 512, the spool 514 of the anti-pumping valve 500 can be actuated with a delay of a fixed time from the operation of the second pilot valve 400. More specifically, the second pilot valve 400 is operated by the second signal to put the second pilot chamber 212 of the main control valve 200 into the high pressure, and at a time $t_5$ after the fixed period of time, the high pressure oil in the second pilot chamber 212 flows out to the tank 800 by the function of the anti-pumping valve 500, to put the second pilot chamber 212 into the low pressure again. Even after the second pilot chamber 212 has become the low pressure, the spool 202 is subjected to the force $F_{210}$ by the high pressure oil in the first pilot chamber 210 and is kept pushed rightwards by the force $F_{210}-F_{204}$. The piston 102 can accordingly continue the movement towards the rod 104 side. When the piston 102 has come to the vicinity of the stroke end on the rod 104 side, the position detecting valve 114 is switched at a time $t_6$. Simultaneously therewith, the high pressure oil in the cylinder 100 flows into the oil chamber 602 of the holding valve 600 and switches this holding valve. Further, the high pressure oil flows into the oil chamber 214 of the main control valve 200 to put this oil chamber into the high pressure and to establish the state before applying the first signal. When the second signal is released at a time $t_7$, the second pilot valve 400 is reset by the spring. The flow of the high pressure oil into the oil chamber 508 of the anti-pumping valve 500 is ceased, and the anti-pumping valve 500 is also reset by the spring. In this way, all the operations corresponding to the second signal, i.e., the operations for closing the circuit are completed.

Hereunder, the operations of the hydraulic driving device will be explained as to (I) a case where the first signal or the second signal has been released in a short time in the course of the switching operation of the circuit breaker, (II) a case where the trip-free operation is carried out, and (III) a case where the anti-pumping operation is carried out.

Figure 2:
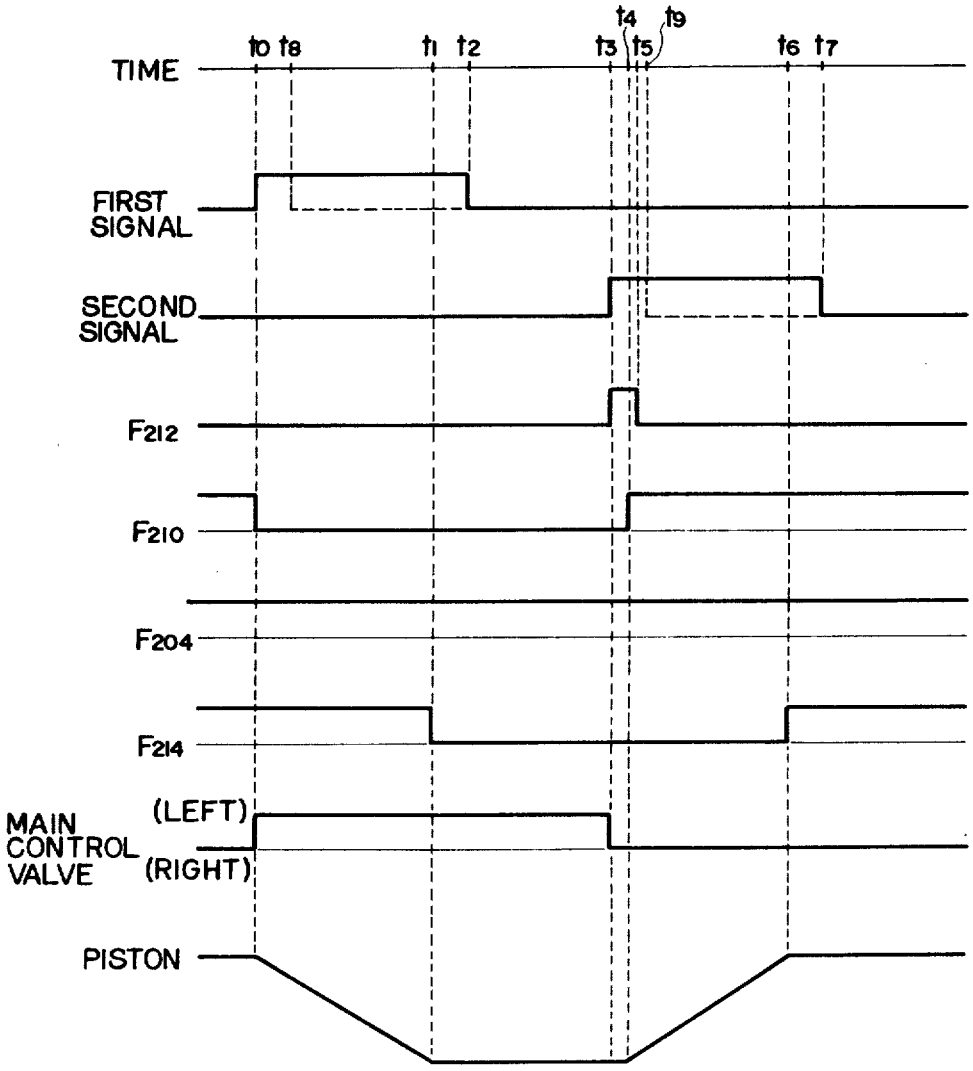
FIG. 2 is a time chart for explaining the operation of the hydraulic driving device in the case where a command for opening a circuit or a command for closing the circuit has been released in a short time.

(I) Referring to FIGS. 1 and 2, even in case where the first signal has been applied and it has been released at a time $t_8$ after a comparatively short period of time, most of the high pressure oil in the oil chamber 208 of the main control valve 200 flows out to the tank 800 via the second valve chamber 206, and hence, the interior of the first pilot chamber 210 does not become the high pressure. Since only the force $F_{204}+F_{214}$ acts on the spool 202, the state in which the spool 202 of the main control valve 200 lies at the left end is held. That is, even when the first signal has been released by any cause in the course of the operation corresponding to this first signal, the operation is continuously carried out.

On the other hand, even in case where the second signal has been applied and it has been released at a time $t_9$ after a comparatively short period of time, the interior of the first pilot chamber 210 is already under the high pressure, and hence, the state in which the spool 202 of the main control valve 200 lies at the right end is held owing to the relation of $F_{210}>F_{204}$. That is, even when the second signal has been released in the course of the operation corresponding thereto, the operation is continuously carried out.

As set forth above, the driving device according to this invention can reliably complete the operation corresponding to the command of the first or second signal even when the signal is of a short duration.

(II) The trip-free operation will be described with reference to FIGS. 1, 3 and 4.

Figure 3:
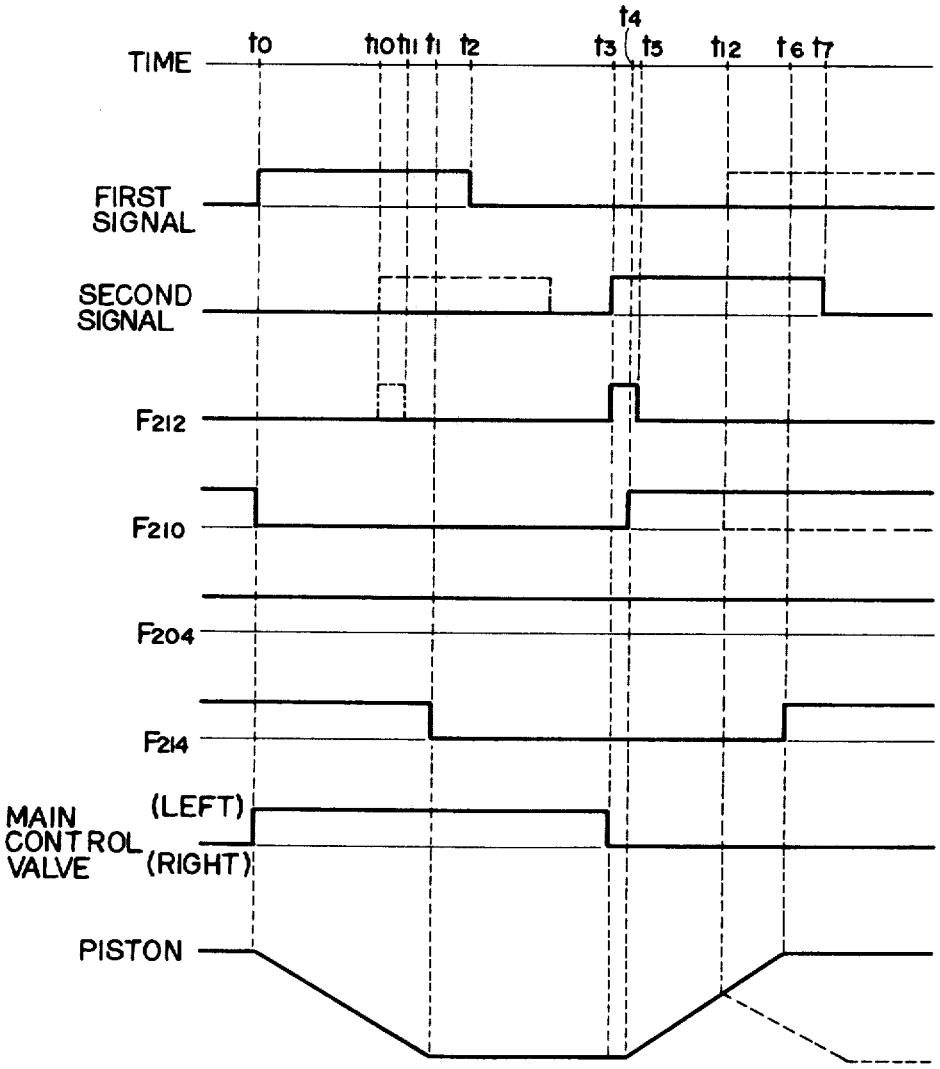
FIG. 3 is a time chart for explaining the trip-free operation and the anti-pumping operation of the hydraulic driving device.
Figure 4:
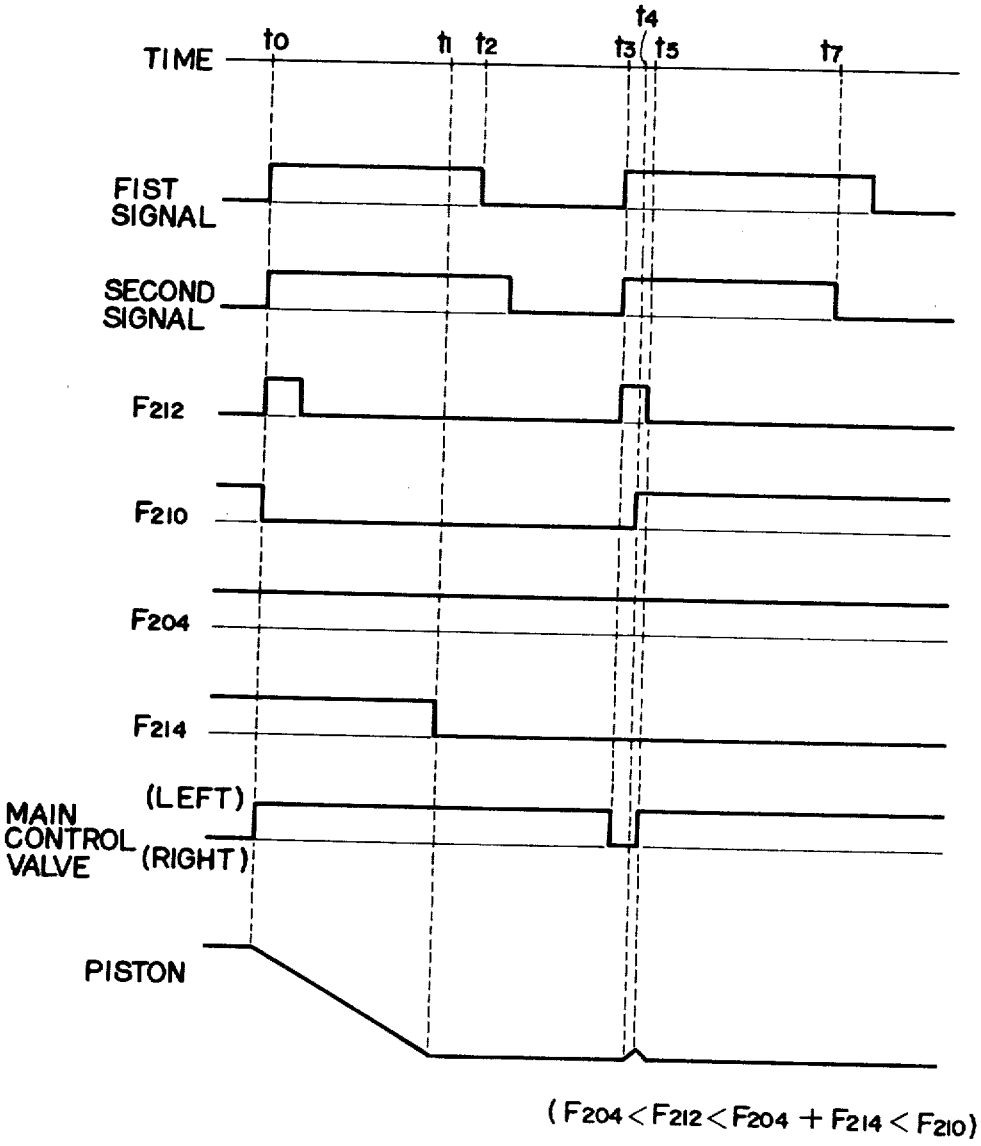
FIG. 4 is a time chart for explaining the operation of the hydraulic driving device in the case where the command for opening the circuit and the command for closing the circuit have been simultaneously given.

In case where the second signal has been impressed erroneously during the operation responsive to the first signal, the device operates as illustrated in FIG. 3 and as stated below. When the second signal is applied to the second pilot valve 400 at a time $t_{10}$ after the impression of the first signal, the spool 202 receives the rightward force $F_{212}$ owing to the oil pressure in the second pilot chamber 212, but it receives the leftward force $F_{204}+F_{214}$ greater than the force $F_{212}$. After all, therefore, the spool 202 is kept pushed leftwards by a force $F_{204}+F_{214}-F_{212}$ and continues the operation corresponding to the first signal. At a time $t_{11}$ after a slight delay with respect to the second signal, the high pressure oil in the oil chamber 212 flows out to the tank 800 via the anti-pumping valve 500 as described before. Accordingly, even when the piston 102 has reached the stroke end on the side opposite to the rod 104 so as to switch the holding valve 600 and to discharge the high pressure oil in the oil chamber 214 of the main control valve 200, the spool 202 is kept pushed leftwards by the force $F_{204}$. Even if the second signal is continuously given, this second signal is neglected, and the operation corresponding to the first signal is continued.

Now, description will be made of the operation of the device in the case where the first signal has been given during the operation corresponding to the second signal. When the first signal is received at a time $t_{12}$ under continuation of the operation corresponding to the second signal, the high pressure oil in the first pilot chamber 210 is caused to flow out to the tank 800 by the first pilot valve 300, and the force $F_{210}$ becomes zero. The spool 202 is pushed leftwards by the force $F_{204}$. As a result, the operation corresponding to the second signal shifts to the operation corresponding to the first signal. That is, even if the operation responsive to the second signal is being conducted, the command of the first signal is preferentially executed.

The operation of the device at the time when the first and second signals have been erroneously applied at the same time will be explained with reference to FIGS. 1 and 4.

When the two signals are simultaneously applied in the state in which the operation of the second signal has been completed, i.e., at the time $t_0$, the high pressure oil in the first pilot chamber 210 flows out to the tank 800 via the first pilot valve 300 and makes $F_{210}=0$. Simultaneously therewith, the high pressure oil flows into the second pilot chamber 212 via the second pilot valve 400. For this reason, the spool 202 is moved leftwards by the force $F_{204}+F_{214}-F_{212}$ and carries out the operation corresponding to the first signal. Slightly later, the high pressure oil in the second pilot chamber 212 is discharged to the tank 800 via the anti-pumping valve 500, and $F_{212}=0$ is established. Accordingly, even when the piston 102 has reached the stroke end on the side opposite to the rod 104 and $F_{214}=0$ has been established, the spool 202 is pushed leftwards by the force $F_{204}$ and completes the operation corresponding to the first signal.

When the two signals are simultaneously applied in the state in which the operation of the first signal has been completed, i.e., at the time $t_3$, the first pilot valve 300 and the second pilot valve 400 operate. The second pilot chamber 212 is once put into the high pressure by the second pilot valve 400 and the spool 202 is moved rightwards by the force $F_{212}-F_{204}$, while the force $F_{210}$ is maintained at zero. Subsequently, $F_{212}=0$ is established by the anti-pumping valve 500, so that the spool 202 is immediately moved leftwards by the force $F_{204}$ and reset to its position corresponding to the first signal. That is, the first signal takes preference. Although the spool 202 is once moved rightwards, it returns leftwards immediately. Therefore, even when the chamber 108 in the cylinder 100 is once put into the high pressure, the piston 102 scarcely moves onto the rod 104 side and it immediately returns to the stroke end on the side opposite to the rod 104.

As set forth above, the hydraulic driving device according to this invention can preferentially execute the first signal in case where the first signal and the second signal have been impressed simultaneously or successively.

(III) Lastly, the anti-pumping operation will be explained with reference to FIGS. 1 and 3. Even when the first signal is released after the second signal has been applied in the course of the operation corresponding to the first signal and the trip-free operation has been effected as described previously, the operation proceeds as follows if the second signal is continuously given. Even when, in the trip-free operation, the second pilot chamber 212 is temporarily made the high pressure by the second signal, $F_{212}=0$ is established at a time $t_{11}$ by the function of the anti-pumping valve 500. $F_{212}=0$ is still held at the time $t_2$ at which the first signal is released. This state is maintained until the next second signal is applied after the second signal has been once released and the anti-pumping valve 500 has been reset. Thus, the anti-pumping operation is achieved in accordance with the hydraulic driving device of this invention.

In the embodiment shown in FIG. 1, the high oil pressure acts on the chamber 106 in the cylinder 100. In principle, however, a similar effect is attained by a structure wherein the piston 102 is endowed with a downward force by a spring and wherein the chamber is open to the low oil pressure source. Since the second pilot valve 400 does not require a speediness as in the first pilot valve 300, the magnet valve is used in the embodiment. However, the second pilot valve is capable of a high-speed operation by employing a force motor as in the first pilot valve 300.

What we claim is:

1. A hydraulic driving device comprising:

a cylinder;

a piston which slides within said cylinder;

a main control valve which includes a valve body and a spool sliding within said valve body and which is formed between said valve body and said spool with a first oil chamber communicating with a high oil pressure source, a second oil chamber communicating with a low oil pressure source and a third oil chamber communicating with either of said first and second oil chambers and a chamber in said cylinder, said chamber in said cylinder communicating with either of said first oil chamber and said second oil chamber through said third oil chamber in correspondence with a position of said spool driven by oil pressure changes within the respective oil chambers;

characterized in that said main control valve is further formed with a fourth oil chamber, a fifth oil chamber and a sixth oil chamber, and said spool is provided with first surfaces upon which oil pressures in said fourth and fifth oil chambers act in a first direction connecting said first oil chamber and said chamber in said cylinder when these fourth and fifth oil chambers communicate with said high oil pressure source and second surfaces upon which oil pressures in said first and sixth oil chambers act in a second direction connecting said second oil chamber and said chamber in said cylinder; and said hydraulic driving device further comprising:

a first valve and first signal producing means for impressing a first signal to actuate said first valve, said first valve communicating said third oil chamber and said fourth oil chamber while said first signal is not impressed and communicating said fourth oil chamber and said low oil pressure source when said first signal is impressed, and a valve arrangement, having at least a second valve, and second signal producing means for impressing a second signal to actuate said second valve, said valve arrangement communicating said fifth oil chamber and said high oil pressure source while said second signal is impressed and communicating said fifth oil chamber and said low oil pressure source when said second signal is released, wherein said main control valve, first valve and valve arrangement includes means for enabling said spool to complete a movement in said first or second direction for opening or closing said communication between said chamber in said cylinder and said first or second chamber in response to said first or second signal even if said first or second signal is terminated after a short interval and prior to completion of said movement.

2. A hydraulic driving device as set forth in claim 1, wherein each of the forces exerted on said spool by said oil pressures in said fourth and fifth oil chambers is greater than the force exerted on said spool by an oil pressure in said first oil chamber.

3. A hydraulic driving device comprising:

a cylinder, a piston which executes a stroke within said cylinder, a main control valve including a spool and a valve body which has a first oil chamber communicating with a high oil pressure source, a second oil chamber communicating with a low oil pressure source, and a third oil chamber communicating with either of said first and second oil chambers and a chamber in said cylinder, said chamber in said cylinder communicating with either of said first oil chamber and said second oil chamber through said third oil chamber in correspondence with a position of said spool driven by oil pressure changes within the respective oil chambers, characterized in that said main control valve further has a fourth oil chamber, a fifth oil chamber and a sixth oil chamber, and that said spool is provided with first surfaces upon which oil pressure in said fourth and fifth oil chambers act in the direction of communicating said first oil chamber and said chamber in said cylinder when said fourth and fifth oil chambers communicate with said high oil pressure source and second surfaces upon which oil pressure in said first and sixth oil chamber act in the direction of communicating said second oil chamber and said chamber in said cylinder when the oil pressure in said sixth oil chamber is a high pressure, and said hydraulic driving device further comprising:

a first valve and first signal producing means for impressing a first signal to actuate said first valve, said first valve communicating said third oil chamber with said fourth oil chamber while said first signal is not impressed and communicating said fourth oil chamber with said low oil pressure source when said first signal is impressed, a valve arrangement, having at least a second valve, and second signal producing means for impressing a second signal to actuate said second valve, said valve arrangement communicating said fifth oil chamber with said high oil pressure source while said second signal is impressed and communicating said fifth oil chamber with said low oil pressure source when said second signal is released, and a third valve which communicates said sixth oil chamber with said high oil pressure source while said piston is operating in correspondence with said first signal and which communicates said sixth oil chamber with said low oil pressure source while said piston is operating in correspondence with said second signal, and means for acting upon said third valve in response to said piston nearing ends of its stroke for effecting reverse movement of the main valve, wherein said main control valve, first valve, valve arrangement, and third valve includes means for enabling said first signal to take precedence over said second signal whenever both of said signals are impressed simultaneously and whenever said signals are impressed in an overlapping manner prior to completion of an operation produced in accordance with one of said signals.

4. A hydraulic driving source as set forth in claim 3, wherein the sum of the forces exerted on said spool by the oil pressures in said first and sixth oil chambers is greater than the force exerted on said spool by said oil pressure in said fifth oil chamber and is smaller than the force exerted on said spool by said oil pressure in said fourth oil chamber.

5. A hydraulic driving device according to claim 3, wherein said means for acting upon said third valve comprises detecting means provided within said cylinder at locations corresponding with the ends of the stroke of said piston for acting upon said third valve in accordance with the position of said piston.

6. A hydraulic driving device comprising:

a cylinder, a piston which executes a stroke within said cylinder, a main control valve including a spool and valve body which has a first oil chamber communicating with a high oil pressure source, a second oil chamber communicating with a low oil pressure source, and a third oil chamber communicating with either of said first and second oil chambers and a chamber in said cylinder, said chamber in said cylinder communicating with either of said first oil chamber and said second oil chamber through said third oil chamber in correspondence with a position of said spool driven by oil pressure changes within the respective oil chambers, characterized in that said main control valve further has a fourth oil chamber, a fifth oil chamber and a sixth oil chamber, and that said spool is provided with first surfaces upon which oil pressure in said fourth and fifth oil chambers act in the direction of communicating said first oil chamber and said chamber in said cylinder when said fourth and fifth oil chambers communicate with said high oil pressure source and second surfaces upon which oil pressure in said first and sixth oil chamber act in the direction of communicating said second oil chamber and said chamber in said cylinder when the oil pressure in said sixth oil chamber is a high pressure, and said hydraulic driving device further comprising:

a first valve which communicates said third oil chamber with said fourth oil chamber while a first signal is not impressed and which communicates said fourth oil chamber with said low oil pressure source when said first signal is impressed, a valve arrangement, having at least a second valve, which communicates said fifth oil chamber with said high oil pressure source while a second signal is impressed and which communicates said fifth oil chamber with said low oil pressure source when said second signal is released, and a third valve which communicates said sixth oil chamber with said high oil pressure source while said piston is operating in correspondence with said first signal and which communicates said sixth oil chamber with said low oil pressure source while said piston is operating in correspondence with said second signal, and means for acting upon said third valve in response to said piston nearing ends of its stroke for effecting reverse movement of the main valve, further comprising a fourth valve which is disposed at an intermediate position of an oil passage communicating said second valve and said fifth oil chamber of said main control valve and which cuts off the communication between said second valve and said fifth oil chamber and connects said fifth oil chamber and said low oil pressure source, and means for operating said fourth valve after a delay of a fixed time with respect to the operation of said second valve.

7. A hydraulic driving device as set forth in claim 6, wherein the force exerted on said spool by said oil pressure in said fifth oil chamber is greater than the force exerted thereon by an oil pressure in said first oil chamber, and the sum of the forces exerted on said spool by said oil pressures in said first and sixth oil chambers is greater than said force exerted on said spool by said oil pressure in said fifth oil chamber and is smaller than the force exerted thereon by an oil pressure in said fourth oil chamber.

* * * * *